US005555912A

United States Patent [19]

Saadi et al.

[11] Patent Number: 5,555,912

[45] Date of Patent: Sep. 17, 1996

[54] SPOUT ASSEMBLY FOR AUTOMATIC FAUCETS

[75] Inventors: Robert E. Saadi; Brian N. Creager; Allen R. Becker, all of Erie, Pa.; Stephen R. Kovey, Glen Ellyn, Ill.

[73] Assignee: Zurn Industries, Inc., Erie, Pa.

[21] Appl. No.: 426,526

[22] Filed: Apr. 20, 1995

[51] Int. Cl.[6] ..... E03C 1/04; E03C 1/05

[52] U.S. Cl. ..... 137/801; 4/623; 4/678; 251/129.04

[58] Field of Search ..... 4/623, 678; 137/801; 251/129.04

[56] References Cited

U.S. PATENT DOCUMENTS

| | | | |
|---|---|---|---|
| 4,402,095 | 9/1983 | Pepper | 4/623 |
| 4,681,141 | 7/1987 | Wang | 137/607 |
| 4,688,277 | 8/1987 | Kakinoki et al. | 4/623 |
| 4,735,357 | 4/1988 | Gregory et al. | 137/801 X |
| 4,762,273 | 8/1988 | Gregory et al. | 236/93 R |
| 4,886,207 | 12/1989 | Lee et al. | 251/129.04 X |
| 4,894,874 | 1/1990 | Wilson | 251/129.04 X |
| 4,915,347 | 4/1990 | Iqbal et al. | 251/30.03 |
| 4,953,236 | 9/1990 | Lee et al. | 4/194 |
| 4,955,535 | 9/1990 | Tsutsui et al. | 251/129.04 X |
| 4,971,106 | 11/1990 | Tsutsui et al. | 137/606 |
| 5,056,562 | 10/1991 | Pawelzik et al. | 137/801 |
| 5,062,164 | 11/1991 | Lee et al. | 251/129.04 X |
| 5,092,560 | 3/1992 | Chen | 251/30.03 |
| 5,224,509 | 7/1993 | Tanaka et al. | 137/801 X |

OTHER PUBLICATIONS

Wellcome Solid–Brass Automatic Faucets Catalog, 1990, 8 pages.

Kohler Installation Instructions, 1991, 8 pages.

*Electronic Faucet Installation Instructions and Owner's Manual*, Speakman Sensorflo Faucets, 1992, 24 pages.

*Faucet Installation*, Delany Flush Valves, 2 pages.

*Primary Examiner*—Gerald A. Michalsky

*Attorney, Agent, or Firm*—Webb Ziesenheim Bruening Logsdon Orkin & Hanson, P.C.

[57] ABSTRACT

A spout assembly for an automatic faucet that is easily assembled and tamper resistant has a transmitter and a receiver for use in detecting the presence of objects near the spout. The hollow spout body has an inlet opening and an outlet opening. A unitary waterway fitting is permanently fixed in the outlet opening of the spout body. The waterway fitting has a water passage therein and a sealable compartment for receiving and orienting the transmitter and receiver.

6 Claims, 3 Drawing Sheets

SPOUT ASSEMBLY FOR AUTOMATIC FAUCETS

BACKGROUND OF THE INVENTION

Throughout public washroom facilities, as a protection against the spread of disease and the waste of water, automatic faucets have been installed. These faucets are activated by placing a hand in the vicinity of the outlet of a faucet spout. Mounted in the faucet spout are sensors (for example, infrared transmitter and receiver assemblies) that detect the presence of an object and activate an electronic circuit to open an automatic water valve controlling the flow to the spout. Because automatic faucets are normally placed in public washrooms, it is desirable that all portions of the automatic faucet be tamper resistant. Also, as with products that will be in the public view, it is desirable that they have a pleasing appearance (aesthetic design) and that multiple models be available from which architects and interior designers may select a particular design. As with all manufactured products, it is desirable that the cost of manufacture, which includes the cost of assembly, is minimized.

Numerous automatic faucet designs have been proposed, for example, as found in U.S. Pat. Nos. 4,681,141; 4,735,357; 5,060,323; 5,165,121; and 5,224,509.

It is an object, according to this invention, to provide an easily assembled, tamper-resistant faucet assembly for an automatic faucet.

It is a further object of this invention to provide a faucet assembly constructed of standardized components for flexibility and variety in the shape of the spout body.

SUMMARY OF THE INVENTION

Briefly, according to this invention, there is provided an automatic faucet spout assembly that is easily and economically assembled and tamper resistant. The spout assembly comprises a transmitter and a receiver assembly for use in detecting the presence of objects near the spout. It further comprises a hollow spout body that has an inlet opening and an outlet opening. The spout body is shaped so that the inlet opening can be fastened over an opening in a surface with the outlet opening spaced laterally therefrom. A unitary waterway fitting is inserted in the outlet opening of the spout body. The waterway fitting comprises an inlet port and a threaded outlet port and a passage therebetween. The waterway fitting also has one or more sealable compartments for receiving and orienting the transmitter and receiver assembly. A water conduit passes through the spout body and out the inlet opening. The water conduit is connected to the inlet port of the waterway fitting. An aerator is threaded to the outlet port. A cable assembly passes through the spout body and out the inlet opening. It is connected at one end to terminals on the transmitter and receiver. A cap seals the interior side of the sealable compartment. A lens seals the exterior side of the sealable compartment. The waterway fitting is secured in the spout body permanently as by the use of rivets. A liquid-tight seal is provided between the waterway fitting and the outlet opening in the spout body to prevent water splashed back toward the spout from entering the interior of the spout body.

According to a preferred embodiment of this invention, the hollow spout body is cast brass which is chrome plated. According to a further preferred embodiment, the lens is a polycarbonate plastic. According to a still further preferred embodiment, the cable assembly exposed outside the spout body is protected by a convoluted stainless steel shroud.

According to one embodiment of this invention, the aerator is easily changeable with special tools to provide various desirable flow rates.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
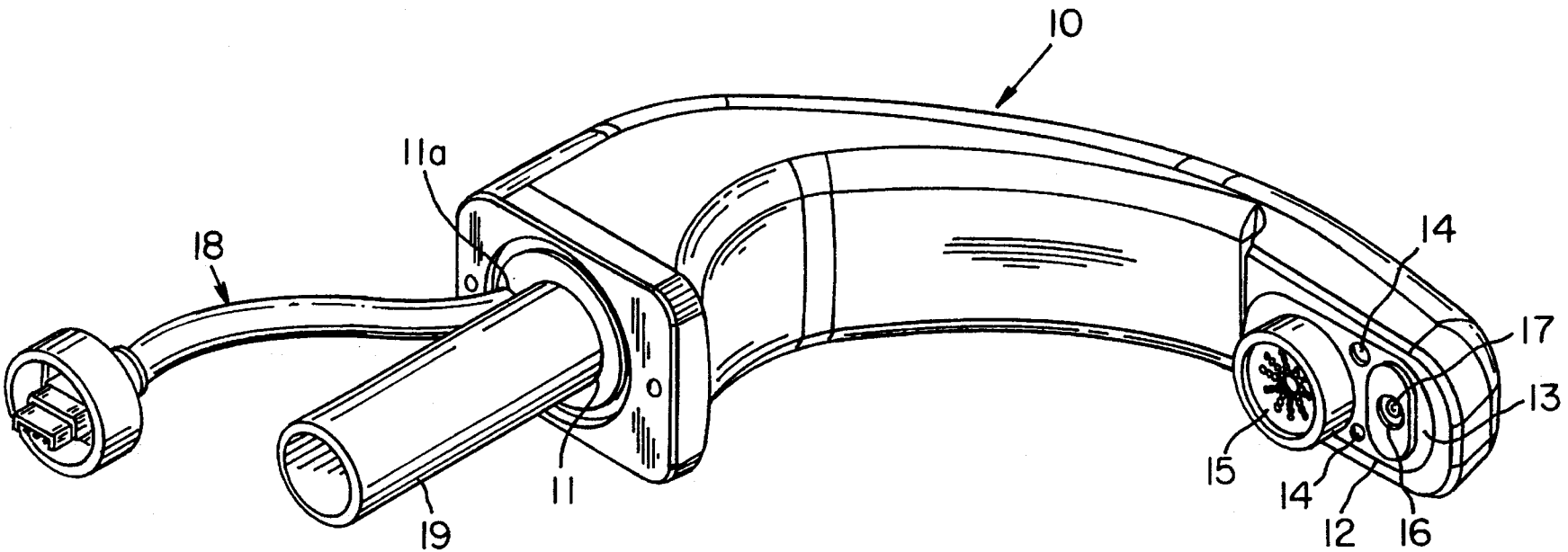
FIG. 1 is a perspective view of a spout assembly according to this invention.

Referring now to FIG. 1, a spout assembly according to this invention comprises a hollow spout body 10 fabricated as a brass casting with external chrome plating. The spout body has a threaded inlet opening 11 and an outlet opening 12. The spout body is shaped so that the inlet opening can be fastened over an opening in a surface, for example, the opening in the surrounding surface of a stationary basin (wash bowl) provided for a faucet. The outlet opening of the hollow spout body is spaced from the inlet opening so that when the spout assembly is attached to the surface, the outlet opening is spaced out over the basin.

Inserted in the outlet opening 12 of the spout body 10 is a unitary waterway fitting 13. The unitary waterway fitting is secured in the opening by rivets 14. The waterway fitting supports the aerator 15. The waterway fitting also supports the transmitter and receiver assembly (not shown) which is protected by lens 16 held in place by screw 17. The aerator is an optional flow rate, vandal-resistant aerator. The lens 16 is made from polycarbonate plastic for impact resistance. The lens is held in place by a screw 17 having a tamper-proof head. Typically, it is an internal hex bore head. Threaded to the bottom of the spout body is a shank 19 which engages threaded inlet opening 11. Adjacent the threaded inlet opening and connected thereto is a small opening 11a through which electric cable assembly 18 passes.

Referring now to FIGS. 3, 4, 5, 6 and 7, there are shown various views of the unitary waterway fitting. The unitary waterway fitting is a brass forging that is machined to provide an inlet port 22 and a threaded outlet port 23. The unitary waterway can be used with hollow spout bodies of numerous configurations so long as the outlet opening in the spout body is standard. Bores 26 are provided to receive rivets 14. Compartments 24 and 25 are provided for receiving the transmitter and receiver, respectively. An edge of each compartment is arranged at an angle from the centerline between the compartments 24 and 25 for the purpose of aiming the transmitter and receiver when in place. The transmitter and receiver are aimed so that their respective lines of sight converge several inches in front of the spout. Bore 32 is arranged to receive a screw 31 on one end for holding a cap (to be described) in place. A recess 33 is provided for receiving the lens 16. The bore 32 is threaded to receive the screw 17 on its other end for holding the lens in place. The ease of assembling the spout assembly, its tamper resistance and its modularity is to a large extent the result of the configuration of the unitary waterway fitting described herein.

Figure 2:
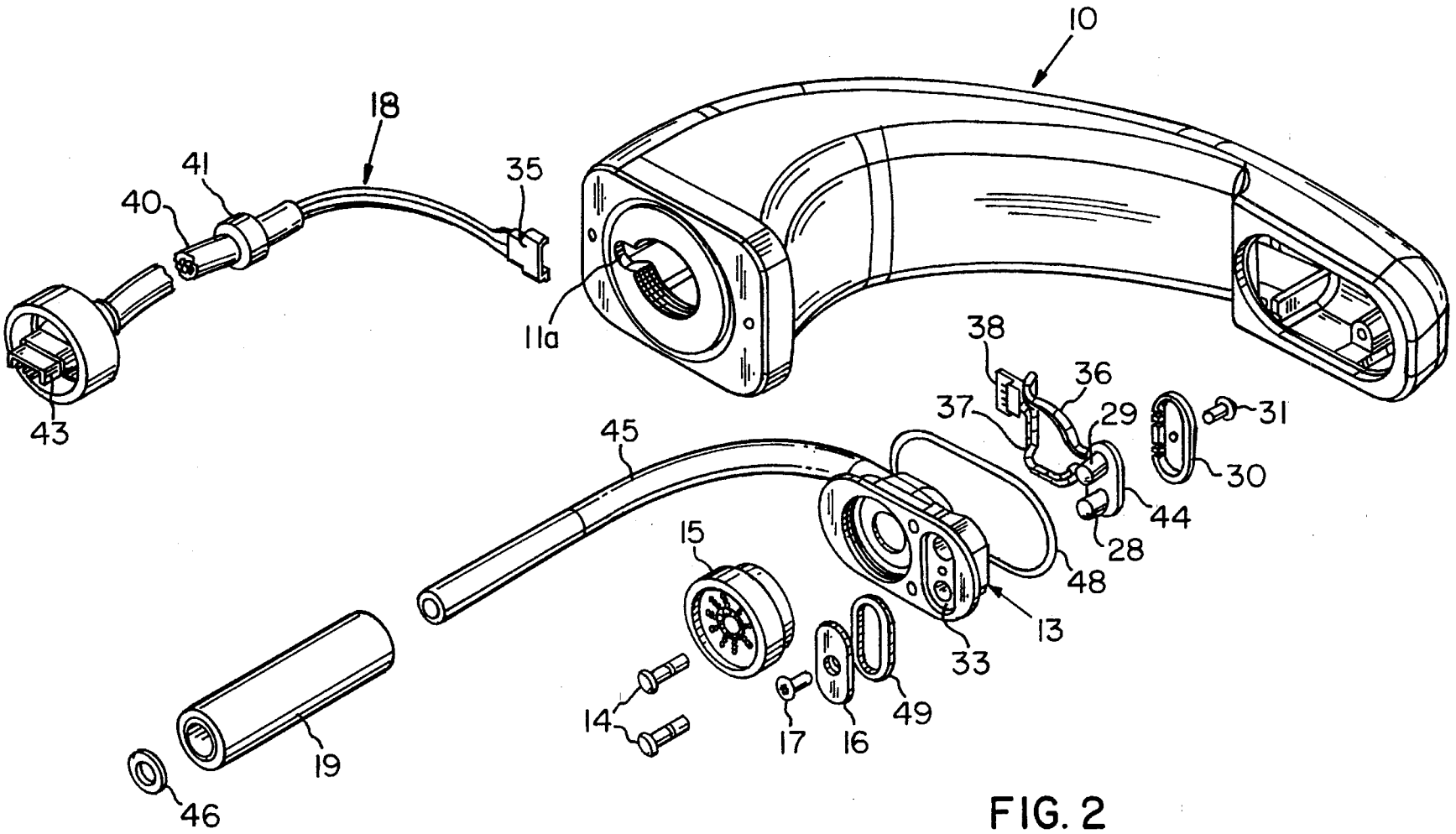
FIG. 2 is an exploded view of the spout assembly shown in FIG. 1.
Figure 3:
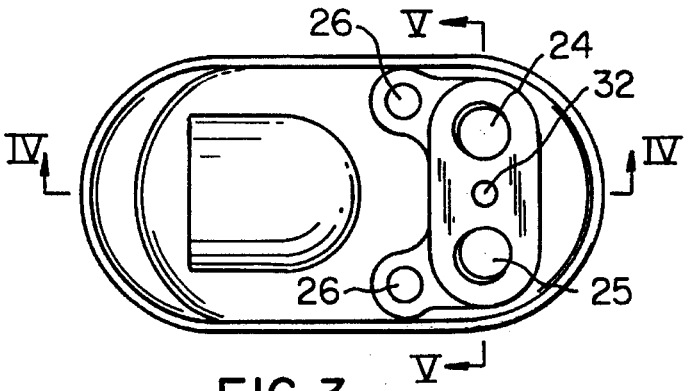
FIG. 3 is a top view of the unitary waterway fitting forming an essential portion of the spout assembly.
Figure 5:
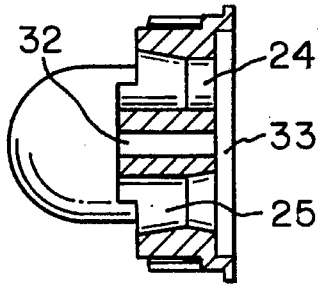
FIG. 5 is a right side view in section along lines V—V of FIG. 3.
Figure 4:
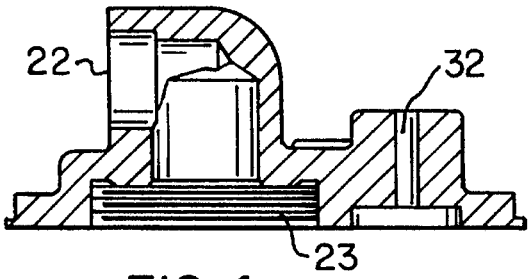
FIG. 4 is an elevation view in section along lines IV—IV of FIG. 3.
Figure 6:
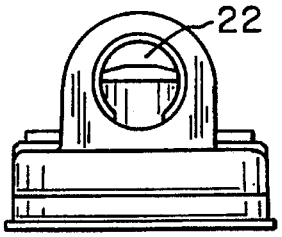
FIG. 6 is a left side view of the unitary waterway fitting.
Figure 7:
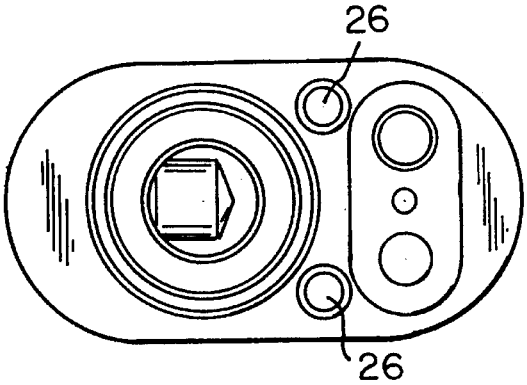
FIG. 7 is a bottom view of the unitary waterway fitting.

Referring now to FIG. 2, a four-wire cable terminates in the connector 35 at one end and in a connector 43 at the other end. A portion of the cable is shrouded by a flexible metal tube 40. A ring 41 is attached to the exterior of the flexible tube so that when the flexible tube is inserted through opening 11*a*, the flexible tube cannot be pulled out of the spout body.

Figure 8:
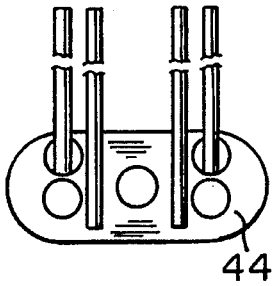
FIG. 8 is a top view of a transmitter and receiver assembly.
Figure 9:
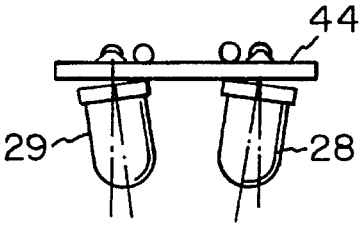
FIG. 9 is a front view of a transmitter and receiver assembly.

The transmitter 28 and receiver 29 are secured to a terminal board 44 which together define a transmitter and receiver assembly. (See FIGS. 8 and 9 for details.) Two-wire cable 36 is secured to the receiver and two-wire cable 37 is secured to the transmitter at the terminal board. The opposite ends of the two-wire cables 36, 37 are mounted in four-wire connector 38. Cap 30 is arranged to enclose the terminal board 44 and is secured to the unitary waterway fitting by screw 31.

Copper tubing 45 forms a water conduit secured to the inlet port of the unitary waterway fitting at one end. At the other end, copper tubing 45 passes into the shank 19. The space between the interior of the shank and the exterior of the copper tubing is liquid-tight sealed by O-ring 46.

The assembly of the faucet will now be described. O-ring 48 is lubricated and positioned around the lower edge of the unitary waterway fitting 13. The O-ring is essential to prevent water splashed back toward the spout body 10 from entering the hollow space within the spout body. The transmitter 28 and receiver 29 are positioned in the compartments provided therefor in the unitary waterway and the cap 30 is placed over the terminal board 44 and secured in place by screw 31. Preferably, a nonelectrically conductive silicon sealant is applied to the periphery of the terminal board before the cap is put in place. Cable assembly 18 is inserted through opening 11 so that the ring 41 is within the spout body 10. Connector 35 is then engaged with connector 38. The copper tube 45 is then fed through the spout and the unitary waterway is riveted in place using two rivets 14. Next, the aerator 15 is attached to the waterway. A lens seal 49 is placed in the waterway and the lens 16 is attached using screw 17. The externally threaded shank 19 is then slid over the copper tube and turned into the threaded inlet opening 11. Finally, the O-ring 46 is inserted in the shank 19 to seal the interior of the shank from the exterior surface of the copper tube 45. The simplicity of the above-described assembly results in an automatic faucet spout assembly that is economical to manufacture.

As should be apparent, the shape of the hollow spout can be changed, for example, lengthened, and still the same parts can be used in its assembly. The copper tubing and electrical cables may need to be lengthened but no other changes are required.

The faucet assembly described herein is particularly useful with a tamper-resistant control unit described in a copending application entitled "Control Unit For Automatic Faucet" filed on the same day and assigned to the same assignee, bearing Ser. No. 08/425,841, and incorporated herein by reference.

Having thus described our invention with the detail and particularity required by the Patent Laws, what is protected by Letters Patent is set forth in the following claims.

We claim:

1. A spout assembly for an automatic faucet that is easily assembled and tamper-resistant comprising:

a transmitter and a receiver for use in detecting the presence of objects near the spout;

a hollow spout body having a threaded inlet opening and an outlet opening, the spout body shaped so that the inlet opening can be fastened over an opening in a surface with the outlet opening spaced therefrom;

a unitary waterway fitting for insertion in the outlet opening of the spout body, the waterway fitting comprising an inlet port, an outlet port and a passage therebetween, the waterway fitting also having a compartment for receiving and orienting both said transmitter and receiver;

a water conduit passing through the spout body and out the inlet opening and being connected to the inlet port of the waterway fitting;

an aerator threaded to the outlet port;

a cable assembly passing through the spout body and out the inlet opening and being connected at one end to the terminals on the transmitter and receiver;

a cap for sealing the interior side of the compartment;

a lens for sealing the exterior side of the compartment;

means for permanently fastening the waterway fitting into the spout body; and means for sealing the waterway fitting in the outlet opening in the spout body.

2. The spout assembly according to claim 1 wherein the hollow spout body is cast brass chrome plated.

3. The spout assembly according to claim 1 wherein the lens is a polycarbonate plastic.

4. The spout assembly according to claim 1 wherein the cable assembly exposed outside the spout body has a convoluted stainless steel shroud.

5. The spout assembly according to claim 1 wherein the aerator is easily changeable to various optional flow rates.

6. The spout assembly according to claim 1 wherein the waterway fitting compartment is sealable.

* * * * *